US005115521A

United States Patent [19]

Adamides

[11] Patent Number: 5,115,521

[45] Date of Patent: May 26, 1992

[54] WATER CONSERVATION APPARATUS FOR WATER CLOSETS

[76] Inventor: Alexander E. Adamides, 834 11th St. No., St. Petersburg, Fla. 33705

[21] Appl. No.: 594,691

[22] Filed: Oct. 9, 1990

[51] Int. Cl.[5] ..... E03D 3/10

[52] U.S. Cl. ..... 4/354

[58] Field of Search ..... 4/354-362

[56] References Cited

U.S. PATENT DOCUMENTS

| | | | |
|---|---|---|---|
| 938,018 | 10/1909 | Opperman | 4/360 |
| 3,553,739 | 1/1971 | Owens | 4/361 |
| 3,820,171 | 6/1974 | Larson | 4/360 |
| 4,115,883 | 9/1978 | Dauvergne | 4/362 X |
| 4,233,698 | 11/1980 | Martin | 4/356 X |
| 4,955,921 | 9/1990 | Basile et al. | 4/354 |

FOREIGN PATENT DOCUMENTS

| | | | |
|---|---|---|---|
| 1128196 | 1/1957 | France | 4/362 |
| 330486 | 10/1935 | Italy | 4/356 |
| 45256 | 10/1961 | Poland | 4/360 |

*Primary Examiner*—Phillips Charles E.

[57] ABSTRACT

A water conserving apparatus for flushing various domestic and industrial vessels such as a restroom fixture commonly known as a Water Closet. The main element of this apparatus is a normally retracted controlled retraction enclosure that resists expansion at a predetermined pressure. Head pressure, a necessary ingredient to produce an efficient flushing action, is synthetically created by storing flushing medium in a valve controlled, fully expanded, controlled retraction receptacle. The operator controlled opening of the valve causes the flushing medium to be released and pushed out at the predetermined resisting pressure of the retracting controlled retraction container. The released high velocity flushing medium is directed to the vessel to be flushed. When the flushing cycle is completed, the valve automatically resets and the controlled reaction receptacle refills with the flushing medium.

5 Claims, 10 Drawing Sheets

WATER CONSERVATION APPARATUS FOR WATER CLOSETS

BACKGROUND OF THE INVENTION

1. Field of the invention

This invention relates to a water conservation apparatus, simulating high head pressure by utilization of potential energy of an axially expansible enclosure designed to resist expansion at a predetermined value, to flush various domestic and industrial vessels such as a restroom fixture commonly known as a Water Closet.

2. Description of Prior Art

There is a number of modern low profile Water Closet water conservation methods presently in use. Mainly, comprising of some device to reduce the volume of liquid in the water closet holding tank. None of these methods produce a satisfactory cleansing flush because of the total lack of flushing medium velocity. The velocity of the flushing medium, which is generally water, is totally dependent upon head pressure which, in the case of the Water Closet holding tank, is directly dependent on the physical dimension of the tank.

There has also been alteration or redesign of the total design of the modern low profile water closet so as to allow flushing with a reduced amount of water. These altered or redesigned water closets generally perform satisfactorily when liquid wastes are flushed. However, when it comes to flushing solid waste, double flushing is generally required.

The only modern low profile water closet to date, that uses a lesser amount of water at increased head pressure employs an enclosed container wherein compressed air is pumped in over water entrapped therein. Water released from the container, assisted by the compressed air, comes out at a relatively high velocity and flushes the water closet. However, the cost of the apparatus is extremely high and the apparatus is not generally suitable for aftermarket installation.

There is no prior art for water conservation apparatus that teaches the use of the potential energy of a normally compressed axially expansible enclosure, specifically designed to resist expansion at a predetermined value, to simulate high head pressure to efficiently flush various domestic and industrial vessels such as a restroom fixture commonly known as a water closet in that Basile U.S. Pat. No. 4,955,921, Owens U.S. Pat. No. 3,553,739, Dauvergne U.S. Pat. No. 4,115,883, Pozzi: French Patent No. 1,128,196, and Piscicelli: Italian Patent No. 330,486 teach the use of enclosed randomly expansive bladders that are dependent upon said enclosures to limit expansion of said bladders. Forcible contraction of said bladders is accomplished by force supplied by something other than the bladders themselves. Larson U.S. Pat. No. 3,820,171, Martin U.S. Pat. No. 4,233,698, and Gajewski: Polish Patent No. 45,256 teach the use of non expansible pressurizing vessels. Opperman: Patent No. 938,018 teaches the use of a valve that operates on the piston principal whereas the valve of this invention application is comprised of a double action wedge that is operated by a piston.

SUMMARY OF THE INVENTION

The object of this invention is to provide a practical water conserving flushing apparatus for flushing a domestic or commercial vessel such as a restroom fixture commonly known as a water closet. The apparatus is of such a design that will readily lend itself to beforemarket and aftermarket installation. The novel feature of this invention is it's ability to synthesize high head pressure in a modern low profile fixture without the use of air pressure or physical height.

The preferred embodiment of the invention comprises a base that is essentially a tube, one end of which is designed to accept the aperture end of the synthesized high head pressure means. The other end of the tube is designed to fit into the entry aperture of the vessel to be flushed. A means, in the form of a double action wedge, is interjected between the ends of the tube to control the flow of water within the tube. An aperture to permit entry of water to the interior of the tube, for the purpose of charging the apparatus, is interjected between the high head pressure means and the double action wedge location.

The synthesized high head pressure means comprises a generally circular tubular wall with the ability to axially expand and contract. For use in this invention, the wall will be in the normally contracted condition with an engineered resistance to expansion. It is this resistance to expansion that determines the amount of synthesized head pressure. One end of the wall, the top, is enclosed with an unperforated panel. The other end of the wall, the bottom, is enclosed with a panel having an aperture fabricated to securely mate with that end of the base which is designed to accept the synthesized high head pressure means. This forms an enclosure with one means of egress and ingress that, when mated with the base, is capable of being expanded by water pressure and contracting, at a predetermined rate, when the water is released.

The retention and release of the water is totally dependent upon the positioning of the double action wedge. When the wedge is in place in the base, the bore is sealed and water pressure expands the enclosure. When the wedge is pulled clear of the bore, the potential energy stored in the expanded enclosure pushes the water through the bore and into the vessel to be flushed. The velocity of the water, the synthesized head, is determined by the forceful rapid retraction of the enclosure.

The extension of the enclosure is limited by a shut off valve positioned to shut off the water, utilizing the physical axial extension of the enclosure, at a predetermined pressure. The enclosure resistance to expansion determines the pressure and eliminates the need for a pressure reducing valve.

The movement of the wedge is controlled by the movement of a water operated piston with an interconnecting shaft to the wedge. In turn, the piston is activated by an operator controlled self closing valve. When the self closing valve is opened, the wedge valve is pulled clear of the base bore. Conversely, when the self closing valve is closed, the wedge valve is pushed back in to the base bore sealing position.

Water is supplied to the apparatus, at available pressure, via an adjustable transition fitting that conveys source water from the exterior of the vessel to be flushed, through the wall of the vessel, to the interior of the vessel to be flushed.

Another embodiment of the invention utilizes a pressure reducing valve, to limit enclosure expansion.

DETAILED DESCRIPTION OF THE INVENTION

The object of this invention is to provide an apparatus that will use a minimal amount of water or any other flushing medium to efficiently flush a water closet bowl. In order to use a minimal amount of water: the water head necessary to provide a cleansing flushing action is provided by an axially expansible enclosure. The enclosure is fabricated in a normally contracted condition and designed to springingly resist expansion at a predetermined level. When the axially expansible enclosure is expanded, due to being filled with water, the built in resistance to expansion of the normally closed enclosure causes the rapid discharge of water when the means to retain the water is removed. The following is a detailed description of how this enclosure is integrated into the apparatus of this invention.

Figure 1:
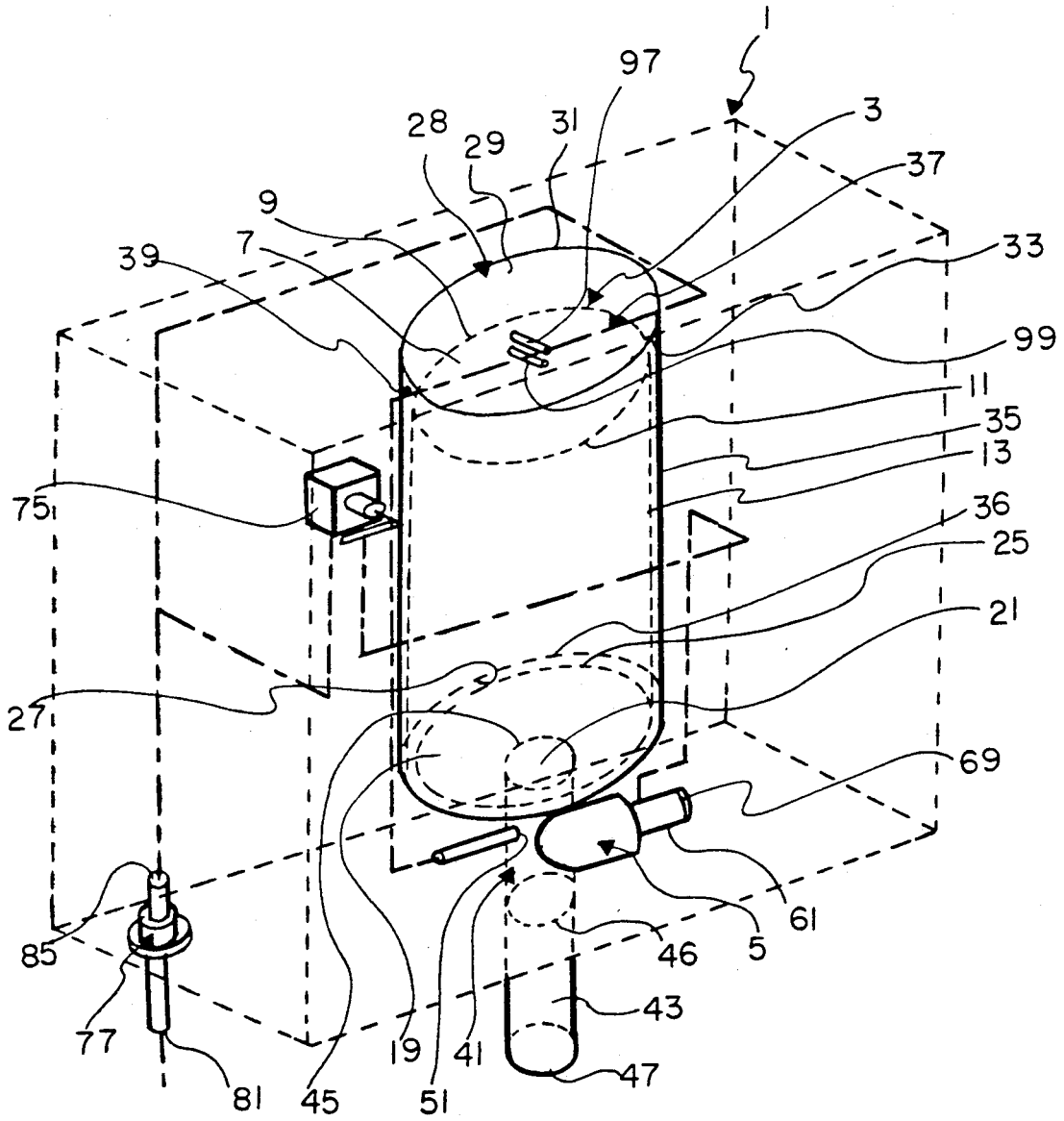
FIG. 1 is a perspective view of the entire apparatus, showing all of the components and their relation to each other, installed in a generally standard water closet holding tank.

The apparatus comprising the invention is shown in FIG. 1. It is installed in a generally standard water closet holding tank 1 of the type that is generally mounted directly on to a water closet bowl. This combination of these two fixtures, a water closet tank and a water closet bowl, is generally referred to as a closet combination. The apparatus comprising the invention, as installed therein, having means for operator control, is designed to minimize the amount of flushing medium, generally water, required to efficiently flush a water closet or any other similar vessel.

The apparatus is comprised of a base 41 of generally tubular configuration having a discharge end 47 and an intake end 21. The discharge end 47 of the base 41 is affixed internally to the discharge aperture 46 of the water closet tank 1 in such a manner as to allow the flushing medium to flow from the water closet tank 1 to the water closet bowl. The base 17 is fitted with a means to facilitate the discharging, retention and replenishment of flushing medium.

Figure 5:
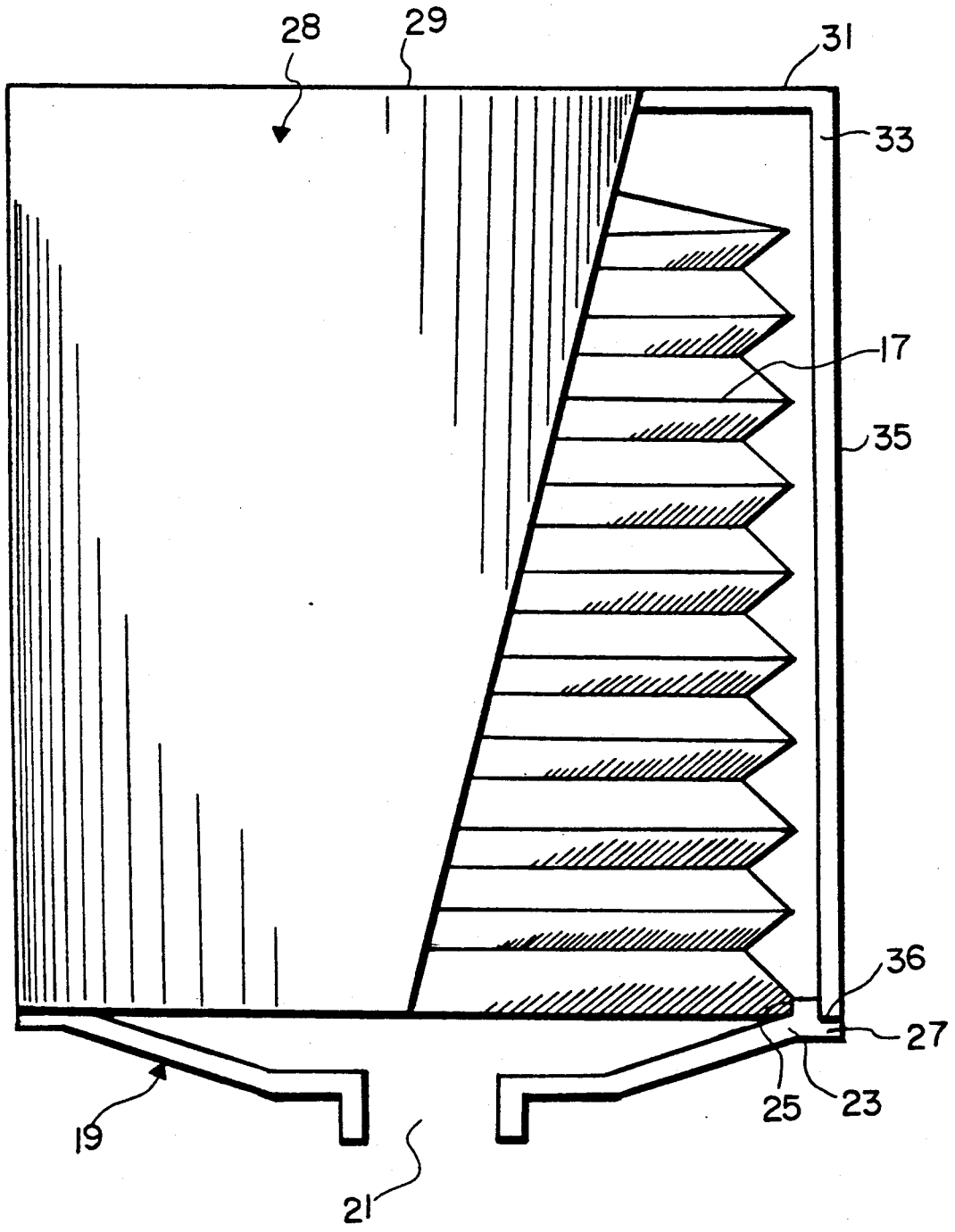
FIG. 5 is a cutaway side view of the cover of the controlled retraction enclosure showing the cover in place over the extended enclosure.
Figure 6:
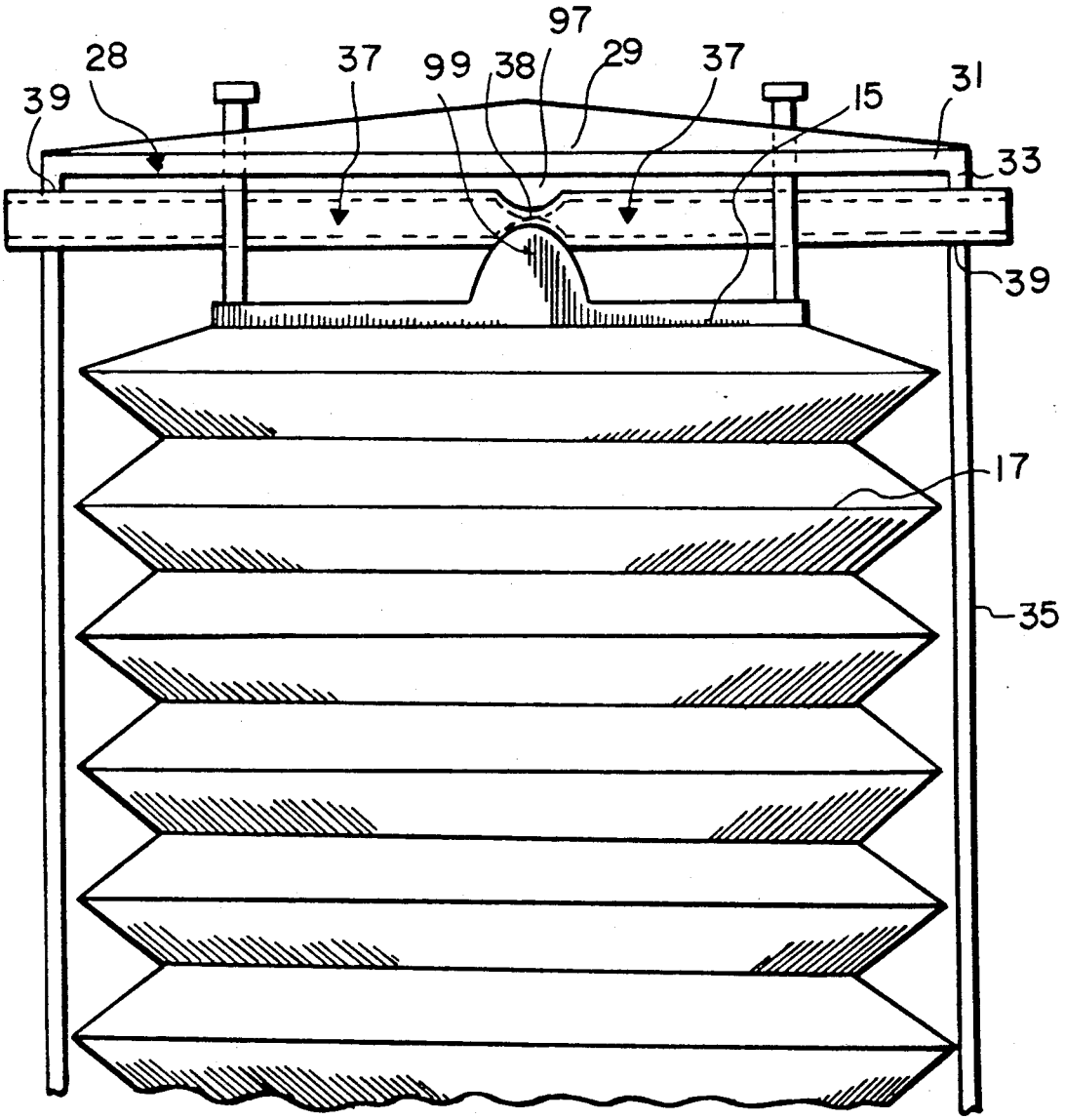
FIG. 6 is a side view of the automated wide range pressure regulator in the closed condition.

Water to flush the water closet is retained in an axially expansible enclosure 3, having a single opening 45 therein and fabricated to mate in a liquid tight manner to the intake end 21 of the base 17. The axially expansible enclosure 3 comprises an unperforated generally circular top panel 7 joined at the periphery 9, in liquid tight fashion, to one edge of a generally cylindrical tubular sidewall 13. The sidewall 13 has a plurality of lateral pleats FIG. 5, 6 and 7 fabricated in such a manner as to allow the sidewall 13 to axially expand and contract in a bellows like manner. To complete the enclosure: a generally circular bottom panel 19, unperforated except for a single opening 21 therein, is joined at the periphery 25, in liquid tight fashion, to the opposite edge of sidewall 13.

Figure 8:
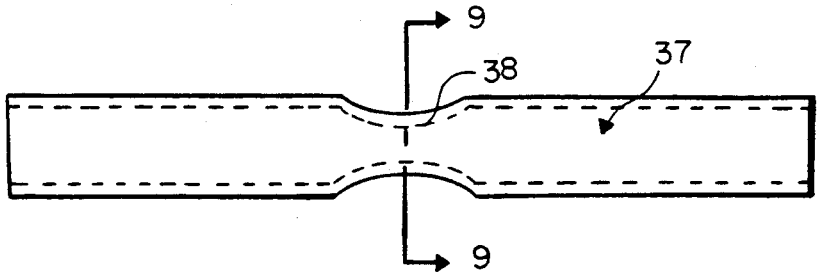
FIG. 8 is a side view of the preformed tube.
Figure 9:
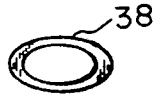
FIG. 9 is a cross section view of the preformed tube of FIG. 8 wherein section A—A is shown.
Figure 10:
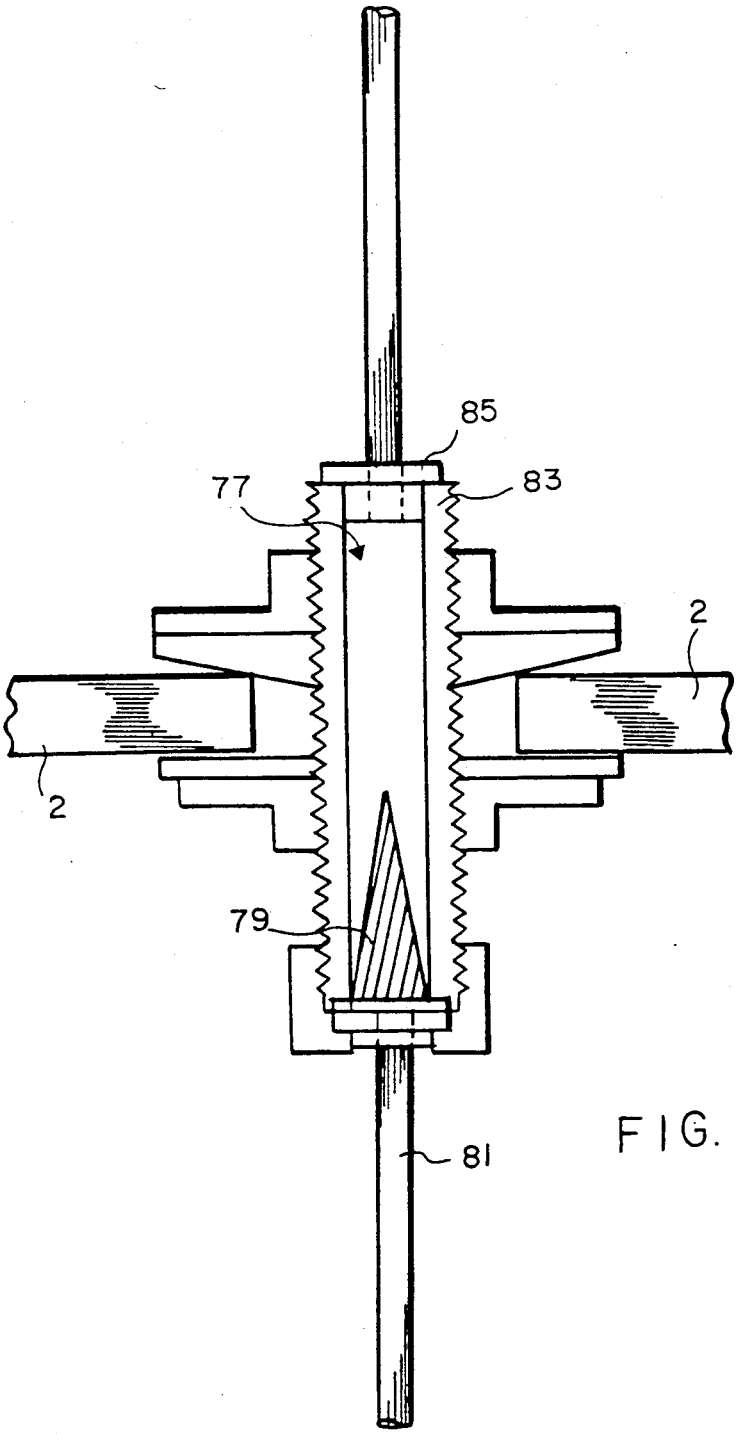
FIG. 10 is a side view cross section of the transition fitting.
Figure 11:
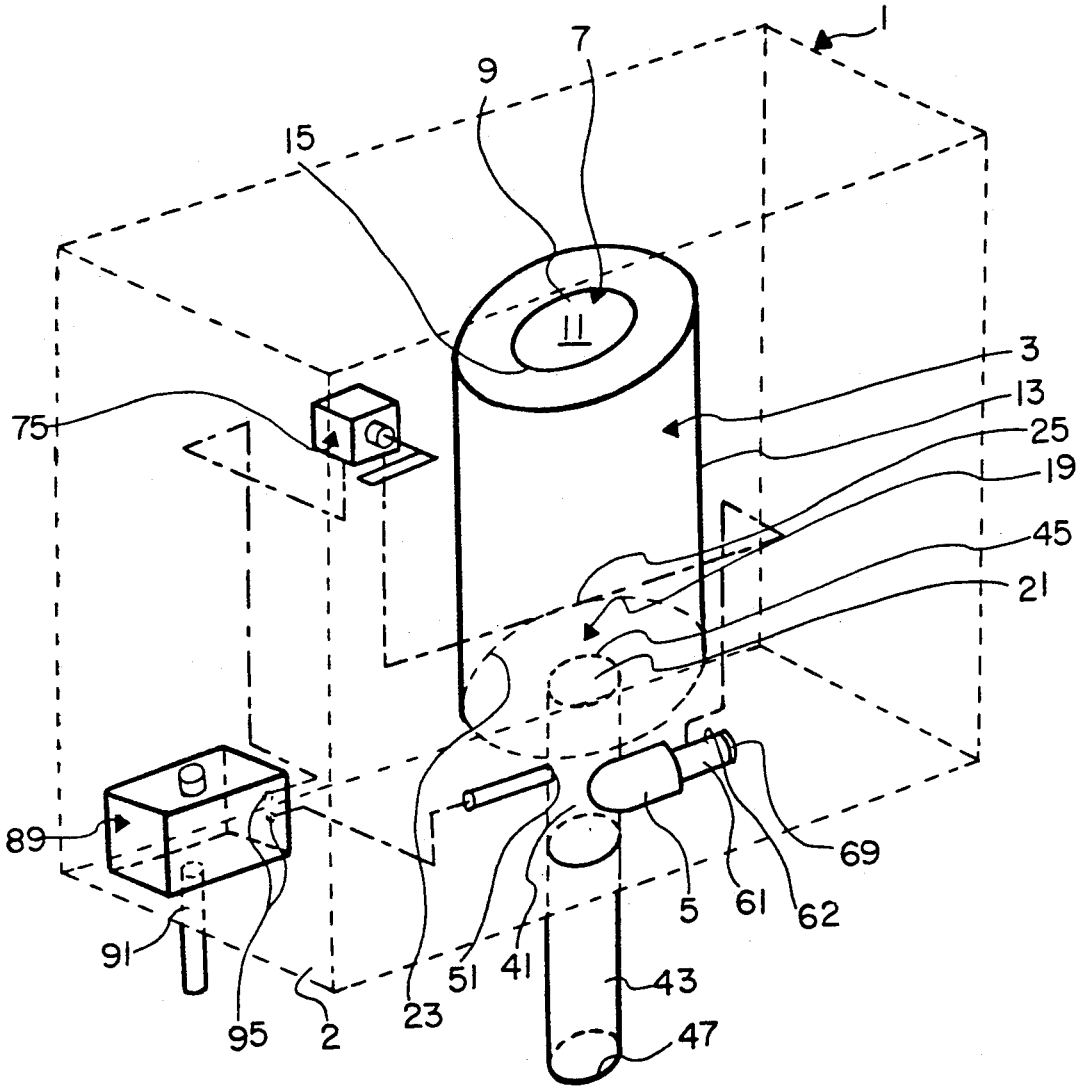
FIG. 11 is a perspective view of an alternate embodiment of the entire apparatus, showing the components and their relation to each other, mounted in a generally standard water closet tank.
Figure 12:
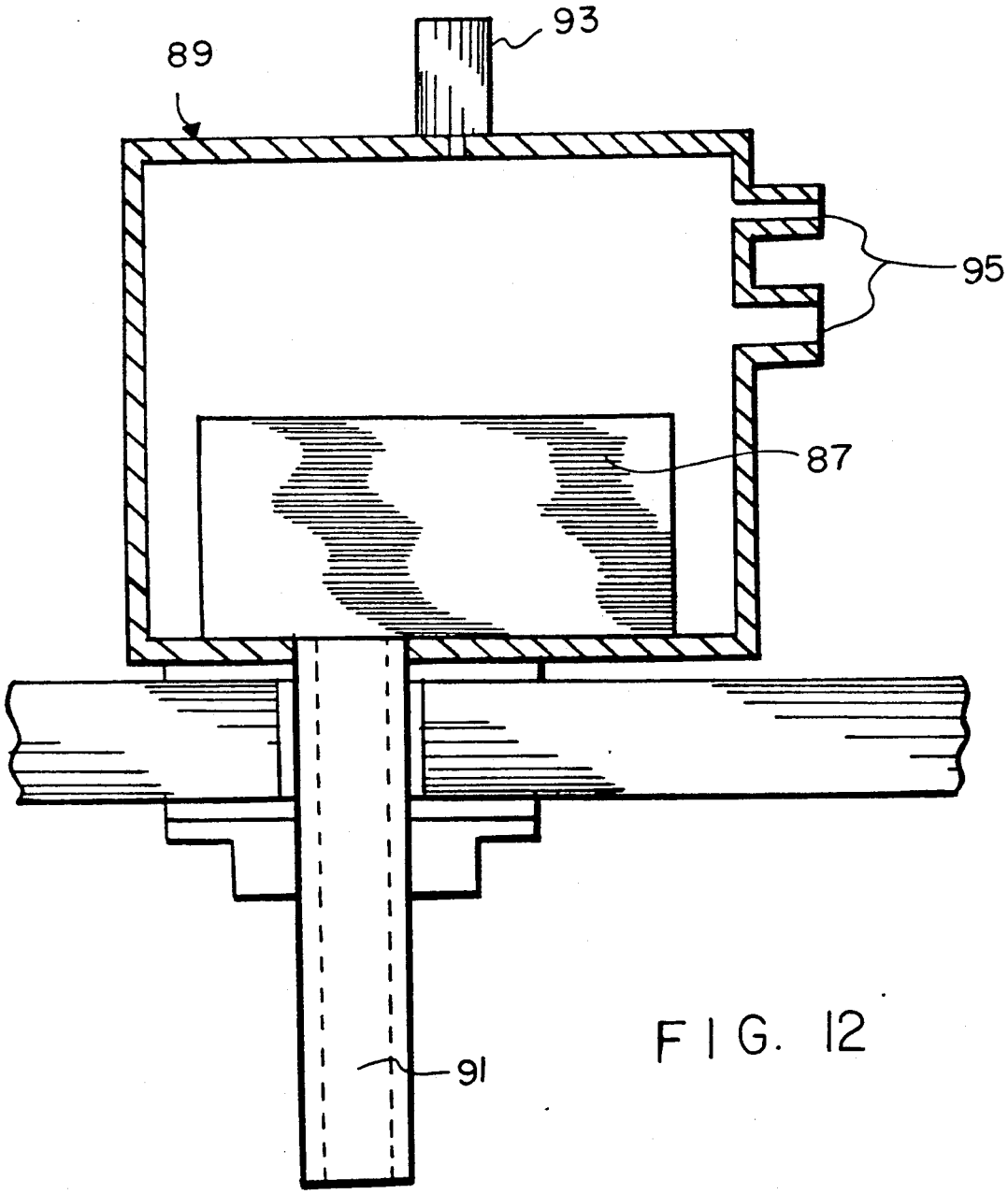
FIG. 12 is a side view cross section an encapsulation showing a pressure reducing valve therein, a pressure relief valve mounted on the exterior and outlets to service the components.

The axially expansible enclosure 3 is enclosed by a cover or housing 28 having a perforated inverted bucket like configuration. The cover is comprised of a perforated generally circular top panel 29 joined at the perimeter 31 to one edge of tubular generally circular sidewall 35. The cover 28 is held in place by anchoring the bottom edge 36 of the cover to ledge 27. The purpose of the cover is two fold: provide mechanical protection to the axially expansible enclosure 3 and to provide a mounting surface for the water inlet shut off structure or in other words the means to bias the axially expansible enclosure 3 to a high value. The means to bias the axially expansible enclosure 3 to a high value is comprised of the following. A generally straight section of performed 38 collapsible tube 37 of FIG. 8 extending across and mounted more or less centrally at the surface of the underside of the cover end panel 28. The intake of the tube originates at the flushing medium supply 85 and the output terminates at the base 17 located flusing medium replenishing aperature 51. Means to collapse the tube 37 comprise a more or less centrally placed ridge 97 fabricated at the underside of the cover end panel 29 having the ridge 97 generally extending across and at right angles to the tube 37. On the opposite side of the tube 37, a similar ridge 99 is placed, in mirror image to the ridge 97 fabricated at the underside of the cover end panel 29, at the exterior surface of the top panel 7 of the axially expansible enclosure 3. The actual biasing of the axially expansible enclosure 3 to a high value is caused when the axially expansible enclosure 3 expands and causes the collapsible tube 37 to be pinched off at the preformed area 38 between the two mirror imaged ridges 97 and 99.

Figure 7:
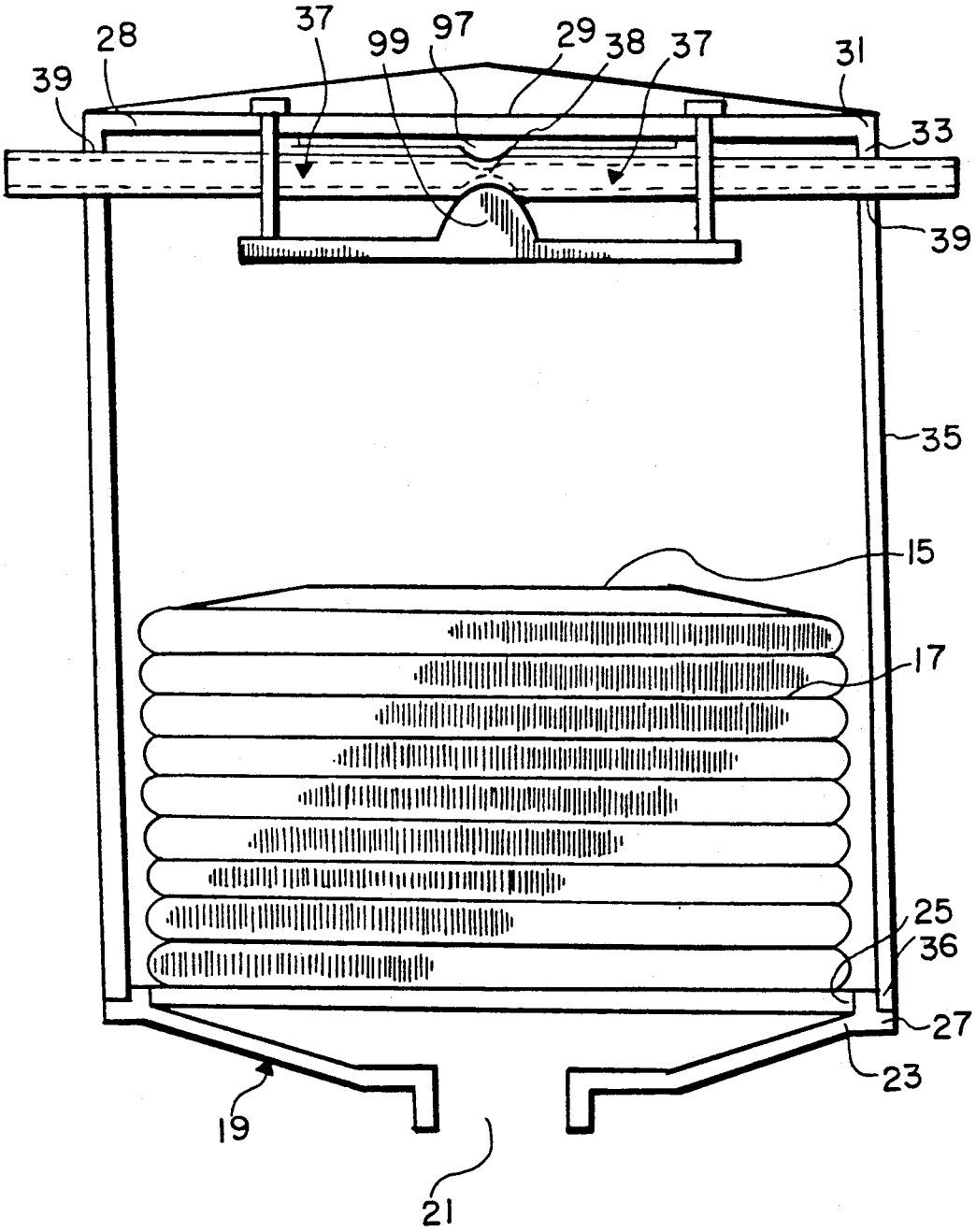
FIG. 7 is a side view of the automated wide range pressure regulator with the controlled retraction enclosure in a retracted condition.

The means to bias the axially expansible enclosure 3 to a low value comprise fabrication of the enclosure 3 in a normally retracted condition FIG. 7 and designed to be springingly resistant to expansion.

Figure 2:
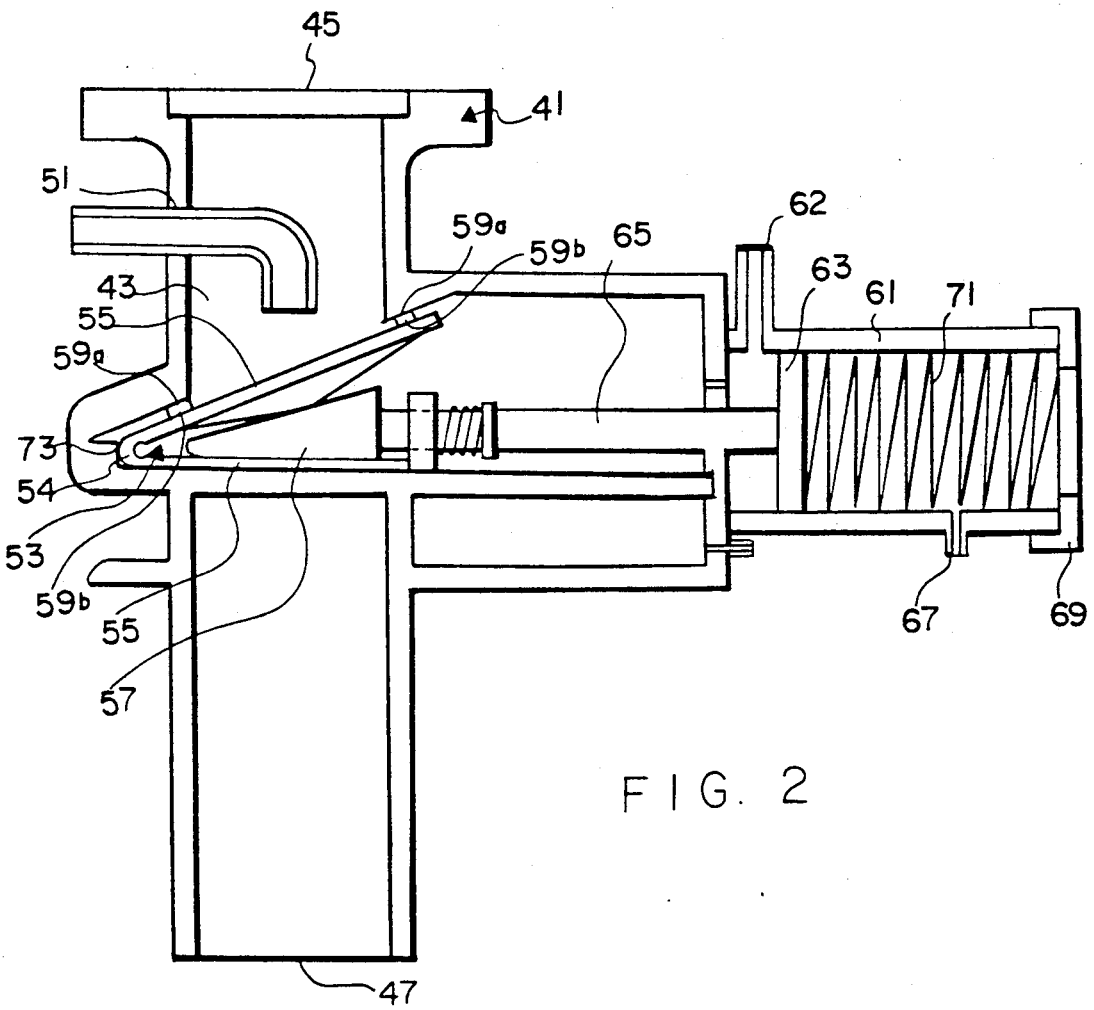
FIG. 2 is a side view of a cross section view of the base showing the double action wedge valve in the sealing condition, the valve operating piston and the recharging aperture.

The base 41 component of the apparatus comprises a generally cylindrical form having a bore 43, as shown in FIG. 2,3,4 extending the entire length thereof. One end of the base 41, designated as the intake end 45, is fabricated to liquid tightly connect to the single opening of the axially expansible enclosure 3 in such a manner as to allow free flow of flushing medium from the axially expansible enclosure 3 to the bore 43 of the base 41. The opposite end of the base, designated as the discharge end 47, is designed to direct the flow of flushing medium to the vessel to be flushed. In the case of the water closet combination, the vessel to be flushed would be a water closet bowl.

Figure 3:
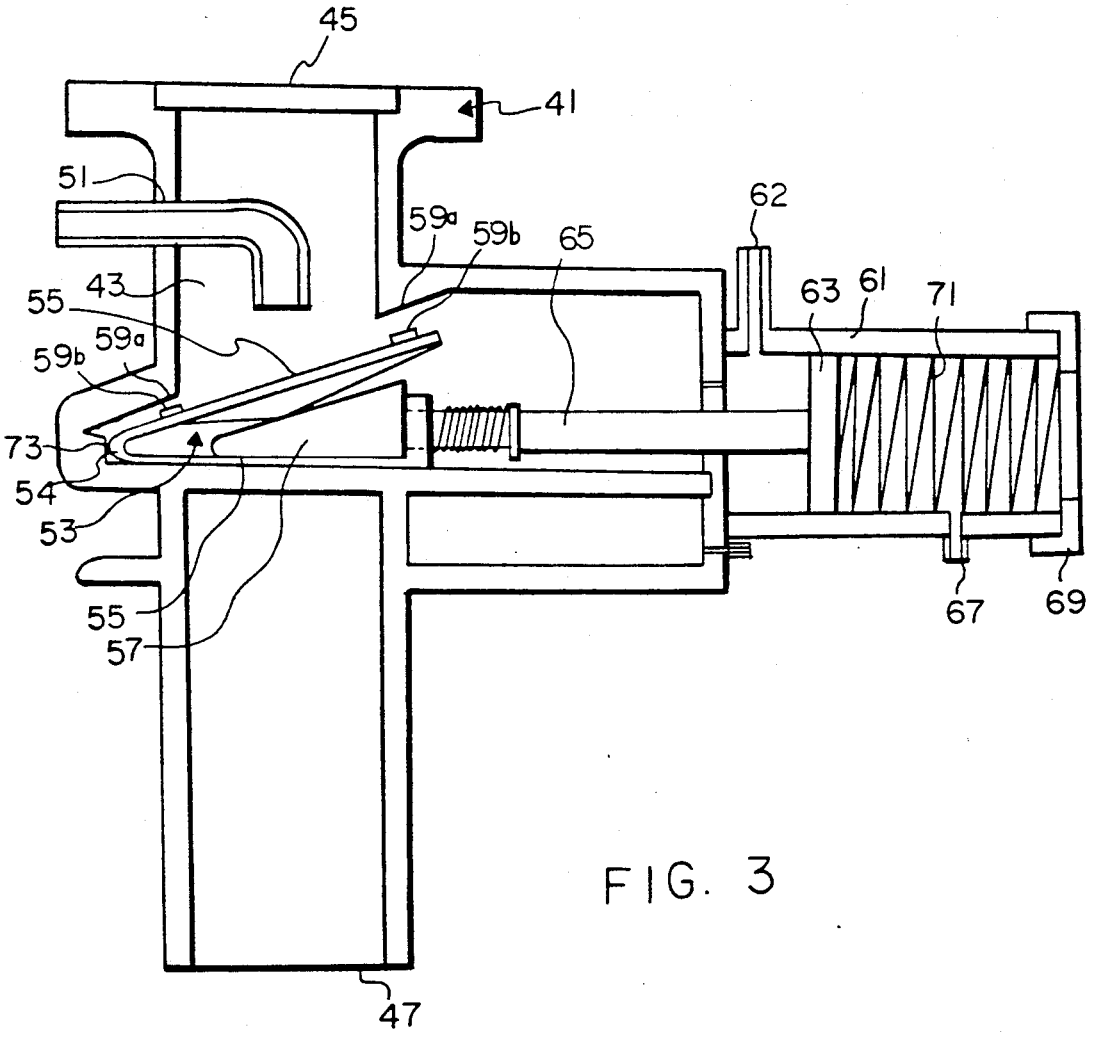
FIG. 3 is a side view of a cross section of the base showing the secondary wedge in the withdrawn position and the subsequent effect on the primary wedge.
Figure 4:
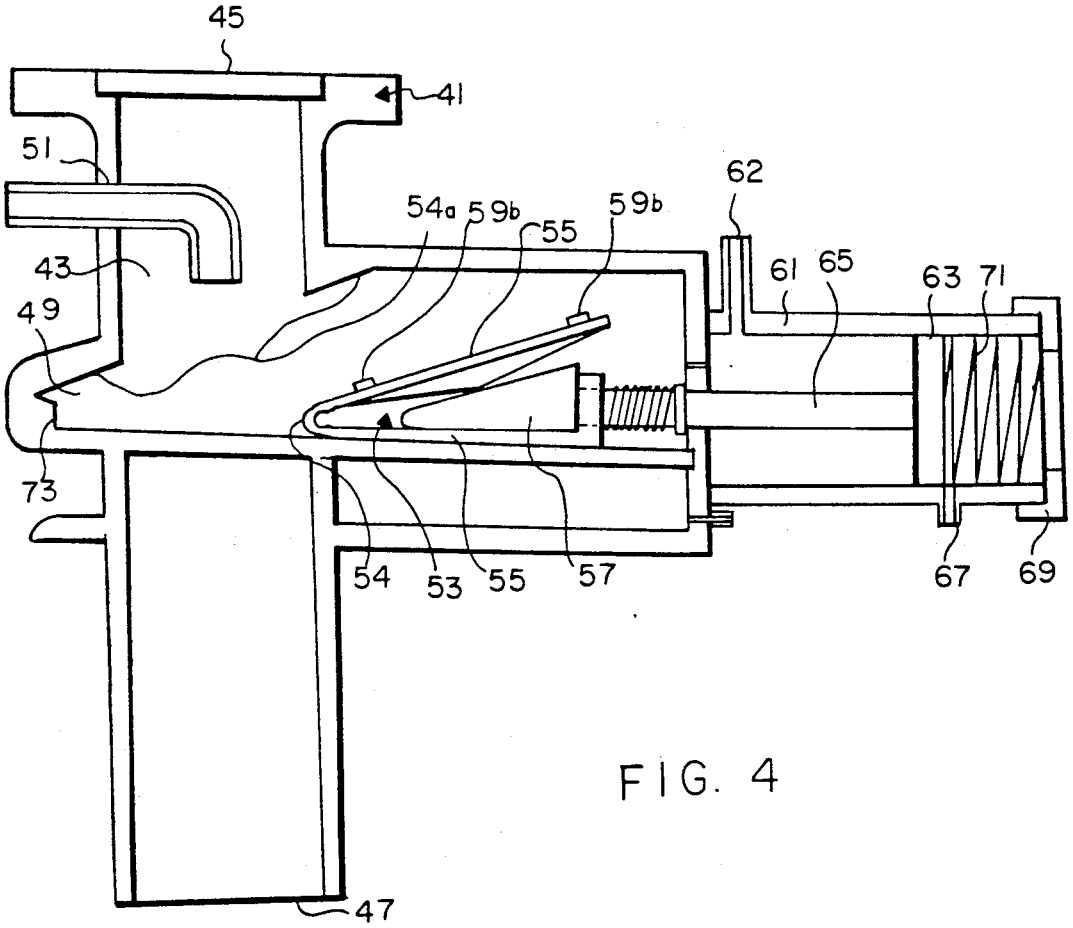
FIG. 4 is a side view of a cross section of the base showing the totally withdrawn double action wedge valve.

In order to control the retention and discharge of flushing medium within the axially expansible enclosure 3, a chamber as shown in FIGS. 2,3,4, interposing the bore 43 of the base 41, is fabricated between the intake and discharge end of the base. The chamber is of such a size and shape as to allow entry and withdrawal of a double action gate 53, as shown in FIG. 2,3,4, of wedge like configuration shaped to sealingly fit into the interposing chamber of the base 41 in such manner as to cause retention of the flushing medium and conversely cause discharge of the flushing medium when the gate 53 is withdrawn.

The double action gate 53 is comprised of a primary wedge of two generally flat plates 55, 55 flexibly joined 54 at one edge of each plate and formed in a normally closed book like configuration. A secondary wedge 57 is interposed between the plates so as to cause the plates 55, 55 to open and seal off the base bore 43 when the secondary wedge 57 is interposed in the direction of the hinge 54. Withdrawal of the secondary wedge 57, in the opposite direction, causes the primary wedge plates 55, 55 to contract and permit easy withdrawal of the double action gate 53.

The double action gate 53 is placed, in a bore 43 sealing attitude, into the base 41 interposing chamber and withdrawn from the chamber by means of an operator controlled cylinder 41 having an internal piston 63 capable of being moved in both directions. The piston is physically connected 65 to the double action wedge 53 in such a manner that when the piston 63 is moved to the end 69 of the cylinder 61 that is farthest away from the base: the wedge 53 is withdrawn from the base 41 interposing chamber causing the retained water to be discharged from the axially expansible enclosure. Conversely, when the piston 63 is moved towards the base: the wedge 53 ius inserted into the base interposing chamber in sealing attitude.

The expended water is replaced via an aperture 51 in the base 41. The aperture 51 is located between the base inlet end 45 and the base interposing chamber so that when the base bore 43 is sealed, replacement water will be forced into the axially expansible enclosure 3.

An alternate embodiment of the invention of the application involves two major changes in that the method to bias the axially expansible enclosure 3 comprises a pressure reducing valve 89 being interposed in the water supply tube 37 between the source of the water 85 and the base water replenishing aperture 51. With this arrangement, the axially expansible enclosure expansion 3 is biased to it's high value by that water pressure that is introduced by the interposing pressure reducing valve 89.

The use of a reducing valve 89 does away with the cover 28 of the preferred embodiment.

All other features of the preferred embodiment remain as shown.

What is claimed is:

1. An apparatus to minimize the amount of flushing medium required to flush a toilet, also known as a water closet having a water tank, or flushing of any other similar vessel comprising:

a housing for enclosing an axially expansible enclosure, said housing being of an inverted bucket shape including an end panel having an underside, a base, being of generally tubular configuration, having a discharge end and an intake end, wherein said discharge end of said base is affixed internally to a discharge aperture of said water closet tank in such a manner as to allow said flushing medium to flow from said water closet tank to a water closet bowl, means to facilitate discharging and retention of said flushing medium, and means to replenish said flushing medium, an axially expansible enclosure, having a top panel adjacent said end panel and built in resistance to expansion and having a single opening therein, wherein said opening is fabricated to mate in a liquid tight manner to said intake end of said base, a gate associated with said chamber to control expulsion of flushing medium therefrom, and wherein said axially expansible enclosure is provided with means to shut off flushing medium inlet, comprising:

a generally straight section of collapsible tube, extending across and mounted substantially centrally at the surface of the underside of said housing end panel, wherein said tube originates at said flushing medium supply and terminates at an aperture in said base so as to supply a flushing medium to said axially expansible enclosure; and means to collapse said collapsible tube comprising: a substantially centrally placed ridge fabricated at said underside of said cover end panel and generally extending across and at right angles to said collapsible tube, and a similar ridge placed on the opposite side of said tube, in mirror image to said cover end panel ridge, at an exterior surface of said axially expansible enclosure top panel wherein: flushing medium passes through said collapsible tube and into said axially expansible enclosure until said enclosure expands to a point where its exterior surface forces said similar ridge to contact and ultimately collapse said tube between said ridges to shut off the flushing medium inlet, while said built in resistance to expansion causes said flushing medium to be expelled from said chamber when said gate is opened.

2. The apparatus as recited in claim 1, wherein said axially expansible enclosure comprises:

an unperforated generally circular top panel joined at the periphery, in liquid tight fashion, to one edge of;

a generally cylindrical tubular sidewall, having a plurality of lateral pleats fabricated in such a manner as to allow said sidewall to axially expand and contract in a bellows like manner, fabricated in a normally retracted condition in such a manner as to springingly resistant expansion; and a generally circular bottom panel, unperforated except for said single opening therein, joined at the periphery in liquid tight fashion, to the opposite edge of said sidewall.

3. The apparatus as recited in claim 1, wherein said gate comprises: a double action gate, of wedge like configuration, shaped to sealingly fit into said interposing chamber of said base in such a manner as to cause retention of said flushing medium; and cause said flushing medium to discharge when said gate is withdrawn from said interposing chamber.

4. The apparatus as recited in claim 3, wherein said double action gate comprises:

a primary wedge of two generally flat plates, flexibly joined and formed in a normally closed book like configuration, and having a secondary wedge interposed, between said plates, in such a manner as to cause said primary wedge to open and seal off said base bore when said secondary wedge is interposed in the direction of said hinge whereas, conversely, withdrawal of said secondary wedge in the opposite direction allows said primary wedge plates to contract.

5. The apparatus as recited in claim 1, further comprising means for operator control:

a self closing valve having an input side connected to said flushing medium source and an output side connected to a cylinder having an internal piston capable of being moved in both directions by pressure applied by the act of opening said self closing valve; having said piston physically connected to said double action gate in such a manner as to facilitate insertion and withdrawal of said gate.

* * * * *